United States Patent [19]

DeVale et al.

[11] Patent Number: 4,836,556

[45] Date of Patent: Jun. 6, 1989

[54] DART GAME TARGET CONSTRUCTION

[75] Inventors: Donald P. DeVale, Sycamore; Robert J. Brejcha; Gregory W. Lantz, both of St. Charles, all of Ill.

[73] Assignee: Kidde Recreational Products Inc., Bay City, Mich.

[21] Appl. No.: 131,950

[22] Filed: Dec. 11, 1987

[51] Int. Cl.[4] ..... F41J 3/02

[52] U.S. Cl. ..... 273/376

[58] Field of Search ..... 273/376, 374

[56] References Cited

U.S. PATENT DOCUMENTS

| | | | |
|---|---|---|---|
| 1,286,215 | 12/1918 | Brainard | 273/376 |
| 3,454,276 | 7/1969 | Brenkert et al. | 273/376 |
| 3,729,197 | 4/1973 | Swanson et al. | 273/376 |
| 4,057,251 | 11/1977 | Jones et al. | 273/376 |
| 4,561,660 | 12/1985 | Zammuto | 273/376 |
| 4,586,716 | 5/1986 | Brejcha et al. | 273/376 |
| 4,706,962 | 11/1987 | Michalski | 273/347 |

FOREIGN PATENT DOCUMENTS

| | | | |
|---|---|---|---|
| 474718 | 4/1915 | France | 273/376 |
| 271262 | 12/1933 | Italy | 273/376 |
| 520021 | 4/1940 | United Kingdom | 273/376 |

OTHER PUBLICATIONS

Project Arachnid Published 12/73 by G.W. Technical Publications Department for the Electronic Systems Group of British Aircraft Corporation, Ltd.

*Primary Examiner*—Richard C. Pinkham
*Assistant Examiner*—Benjamin Layno
*Attorney, Agent, or Firm*—Learman & McCulloch

[57] ABSTRACT

A dart game target having a base on which is assembled a plurality of individual, relatively movable target members separated from one another by a frame having thin ribs interposed between adjacent members. The target members are yieldably biased in a direction away from the base. Movement of the members in a direction away from the base is limited by laterally extending projections carried by the target members which underlie the inner surfaces of the ribs. The arrangement is such that no part of any rib overlies any exposed part of any target member. Warping of the frame or of the base is compensated for by protrusions on selected ones of the ribs which extend in a direction toward the base.

33 Claims, 5 Drawing Sheets

DART GAME TARGET CONSTRUCTION

This invention relates to a dart game target construction of the kind having a plurality of individual, independently movable target sections together forming a target of circular or other geometric configuration and wherein the individual sections are spaced from one another and maintained in assembled relation by a retainer having spaced ribs interposed between and reacting with adjacent target sections wholly internally of the target's outer surface.

BACKGROUND OF THE INVENTION

For many years dart game targets have been of the kind employing a circular, mat-like body having a spider composed of concentric circular and radial wire strands overlying the body and dividing the target surface into a plurality of areas having various score values. Darts have been provided for use with such targets and such darts have been equipped with sharp, metal tips that can be embedded in the target. The wire strands of the spider have been of relatively small diameter, thereby offering little likelihood that a dart tip will rebound as a result of striking the spider.

More recently, electronically scored dart games have become popular. Such games utilize darts having flexible, plastic tips and a target composed of displaceable target sections having closely spaced openings in their outer surfaces for the accommodation of a dart tip. A typical dart and target of this kind are disclosed in Jones et al U.S. Pat. No. 4,057,251.

In all of the known dart games employing flexible, or so-called soft tipped darts, the target is composed of a plurality of individual target sections maintained in assembled relation by means of a spider-like retainer having circular and radial dividers or ribs. The target sections overlie a base and between the base and the target sections is an electrical switch. The target sections are biased in a direction away from the base so that, whenever a thrown dart strikes a target section, the latter is displaced toward the base a distance sufficient to operate the associated switch and actuate a scoring mechanism. Since the target sections are biased in a direction away from the base, some means must be provided to limit their movement away from the base while, at the same time, enabling sufficient movement toward the base to effect operation of the switches.

In the known target constructions the circular and radial ribs of the retaining spider have smooth divider walls accommodated between adjacent sections and each such wall terminates at its outer edge in a barb-like extension which overlies the edges of the adjacent target sections and therefore limits the extent of movement of such sections away from the base under the influence of the biasing means. Since some portion of each target section underlies the retaining barb of the rib, a relatively wide space necessarily exists between the outer or exposed surfaces of adjacent target sections in which the tip of the dart cannot be accommodated in an opening of either section. Consequently, the tip of a dart striking the retaining barb either rebounds, resulting in a miss, or is deflected to one side or the other of the barb.

Because of the width of the retaining barbs, it is desirable to taper the exposed outer surface thereof. Normally, the outer surface tapers from its center toward both opposite edges. To avoid excessive projection of the barbs beyond the outer faces of the target sections, the included angle between a barb's tapering surfaces is relatively large. Thus, when a dart tip strikes a barb, the tip will be deflected. On occasions the angle of deflection may be such that the dart tip is unable to enter a tip-accommodating opening, thereby resulting in a miss.

Since it is desirable to minimize as much as possible the space between adjacent target sections, the spider walls of conventional constructions inwardly of the retaining barbs have been made quite thin. The larger difference in thickness between the barbs and the spider walls, however, can result in an inwardly concave warping of the spider which, unless counteracted, can result in the presence of an inconsistent clearance between a target section and the biasing means or no such clearance at all. Since the sole retaining means for target sections of such conventional constructions constitutes the overlying barb-like retainers at the exposed ends of the spider ribs, warpage can cause forces to be exerted on the target sections which will either prevent free movement of such sections toward and away from the base, or cause excessive clearance or looseness of such sections with resulting imperfect scoring.

A principal objective of the present invention is to provide a target construction adapted for use with soft tipped darts and electronic scoring mechanisms and which overcomes the disadvantages of previously known constructions.

SUMMARY OF THE INVENTION

A target suitable for use in an electronically scored, soft tipped dart game and constructed in accordance with the invention comprises a base on which is secured a retaining frame or spider comprising concentric circular dividers or ribs interconnected by radial dividers or ribs. The ribs are interposed between individual target members which are movable independently of one another toward and away from the base. Each target member has an inner face confronting the base and an outer, exposed face provided with closely spaced, inwardly tapering openings of such size as to receive the tapering tip of a dart. Overlying the base and interposed between the latter and the inner faces of the target members are a pressure sensitive, electrical matrix switch of known kind and a resilient biasing sheet which underlies the inner faces of the target members in a position to bias the latter in a direction away from the base following their being struck by a dart.

The inner ends of the circular and radial ribs are spaced from the biasing sheet and each target member has lateral projections adjacent its inner face that extend into the space between the biasing sheet and the adjacent circular or radial rib and underlie the latter with a slight clearance therebetween. The ribs and the projections thus cooperate to limit movement of the target members in a direction away from the base under the influence of the biasing means, but permit movement of the members toward the base when they are struck by a thrown dart so as to operate the switch and a scoring mechanism actuated thereby.

The outer ends of the spider ribs are not barbed, but are tapered to minimize the possibility of a dart's rebounding should its tip strike the rib. Thus, no part of any circular or radial divider rib overlies any part of a target member. Since no divider rib has a thick barb at its outer edge, warping due to large differences in thickness is avoided.

THE DRAWINGS

A target constructed in accordance with a preferred embodiment of the invention is disclosed in the following description and in the accompanying drawings wherein.

THE PREFERRED EMBODIMENT

Figure 1:
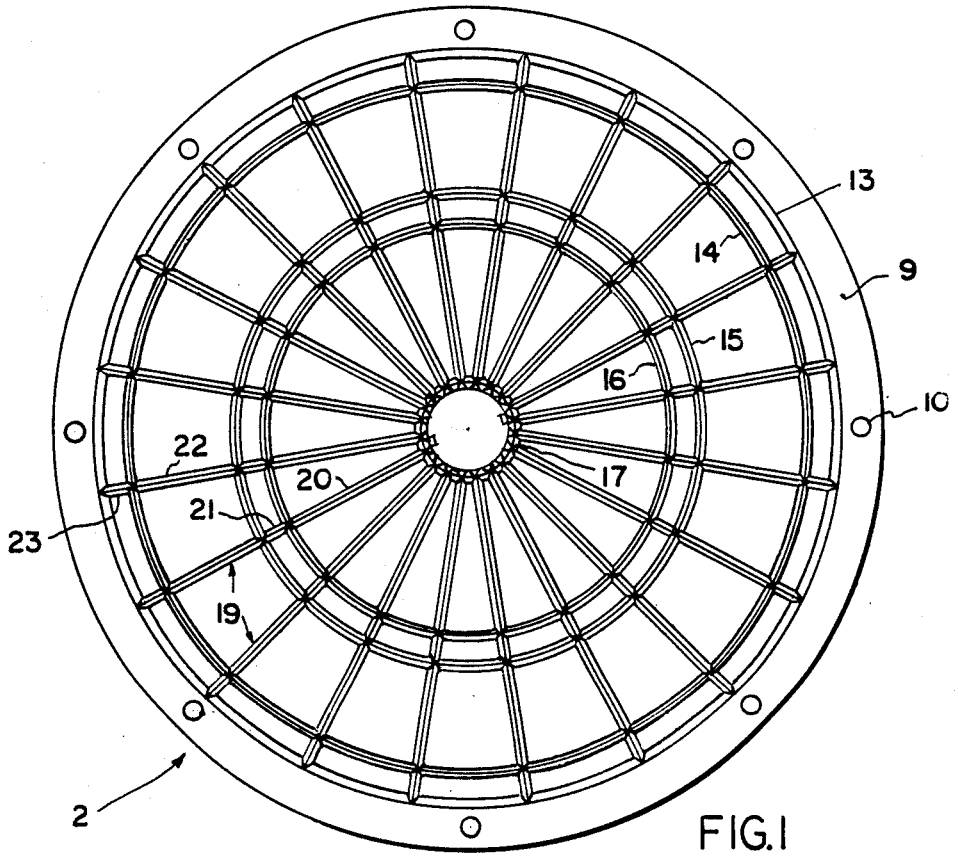
FIG. 1 is a plan view of the outer or exposed face of a target retaining frame, but with the target segments omitted.

A dart game target constructed in accordance with the disclosed embodiment is designated generally by the reference character 1 (FIGS. 3 and 4) and comprises a retaining frame or spider 2, a plurality of radially spaced, circumferentially extending, segment shaped target members 3, 4, 5, and 6, an annular outer bullseye member 7, and a cylindrical inner bullseye member 8.

The retaining spider 2 comprises a mounting flange 9 provided with screw-accommodating openings 10. The spider may be secured to a backboard or base 11 formed of wood, plastic, or other suitable material by means of a plurality of screws 12.

Figure 4:
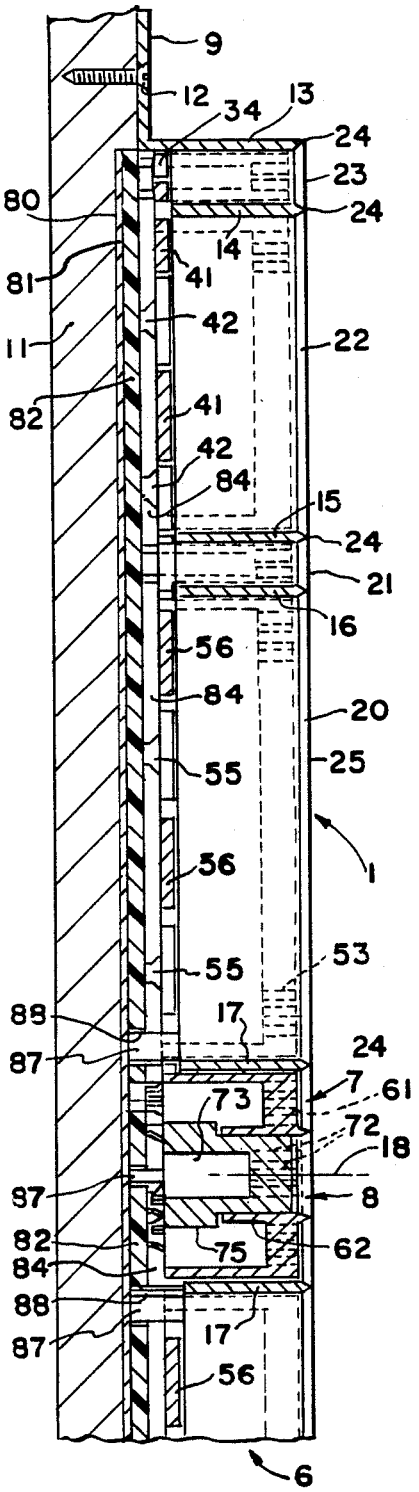
FIG. 4 is a sectional view taken on the line 4—4 of FIG. 3.

Radially inward of the mounting flange 9 the spider includes a plurality of concentric circular dividers or ribs 13, 14, 15, 16, and 17 that are spaced at various radial distances from a common center 18 (FIG. 4). Each of the circular ribs is joined by a plurality of circumferentially spaced, radially extending dividers or ribs 19 each of which has a radially inner section 20 extending outwardly from the innermost ring 17 to the next adjacent rib 16. The circular ribs 16 and 15 are joined by a section 21 of each radial rib 19 and the circular ribs 15 and 14 are joined by another section 22 of each radial rib 19. The circular ribs 14 and 13 are joined by a section 23 of each radial rib 19.

Figure 6:
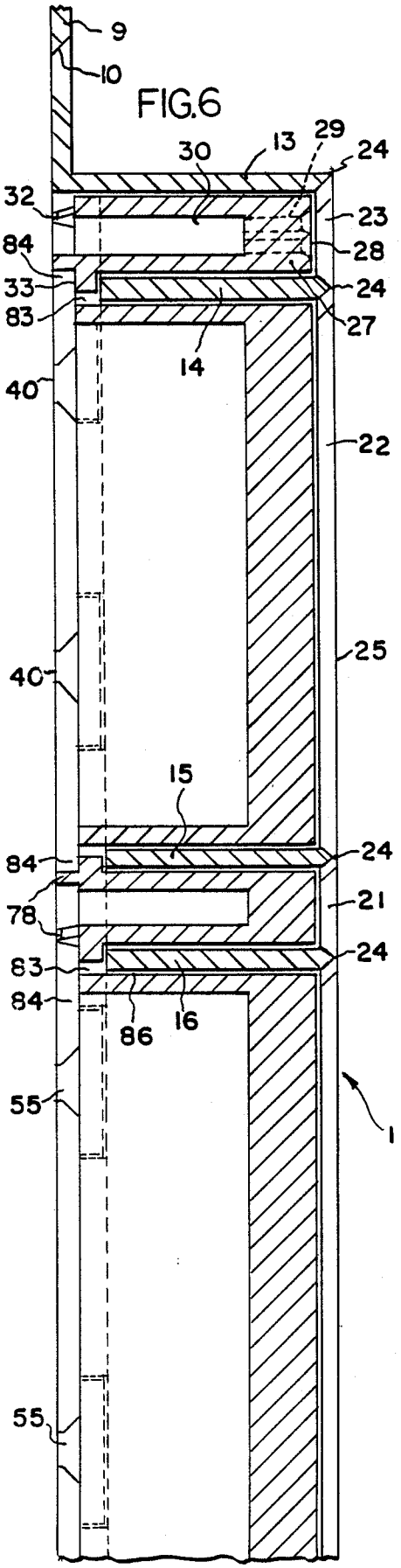
FIG. 6 is a sectional view taken on the line 6—6 of FIG. 5.

As is best shown in FIGS. 4 and 6, the outer or exposed surface of each of the circular ribs 13–17 tapers to a sharp edge 24. The outer or exposed surface of each of the radial ribs 19 similarly tapers to a sharp edge 25.

As also clearly is shown in FIGS. 4 and 6, the outer edges 24 and 25 of all of the circular and radial ribs are coplanar. The height of all ribs also is the same, except that of the outermost circular rib 13 which has a greater height. The significance of the difference in height will be explained hereinafter.

Figure 9:
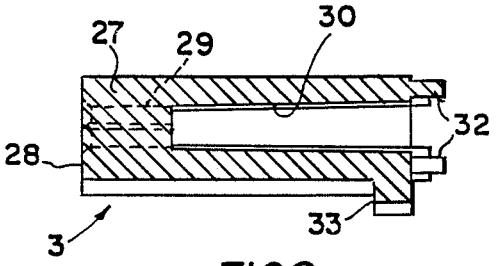

The circular and radial ribs of the spider divide the area thereof into a plurality of open spaces adapted to be occupied by the target members. Thus, between adjacent circular ribs 13 and 14 and between adjacent radial rib sections 23 is a plurality of circumferentially spaced, arcuate, segment shaped spaces in each of which is accommodated the correspondingly shaped target member 3. This target member also is shown in FIG. 9 and comprises a body 27 having an exposed outer face 28. The entire area of the face 28 is provided with a plurality of closely spaced, inwardly tapered openings 29. Each of the openings 29 communicates with a cavity 30 inwardly of the surface 28.

Figure 5:
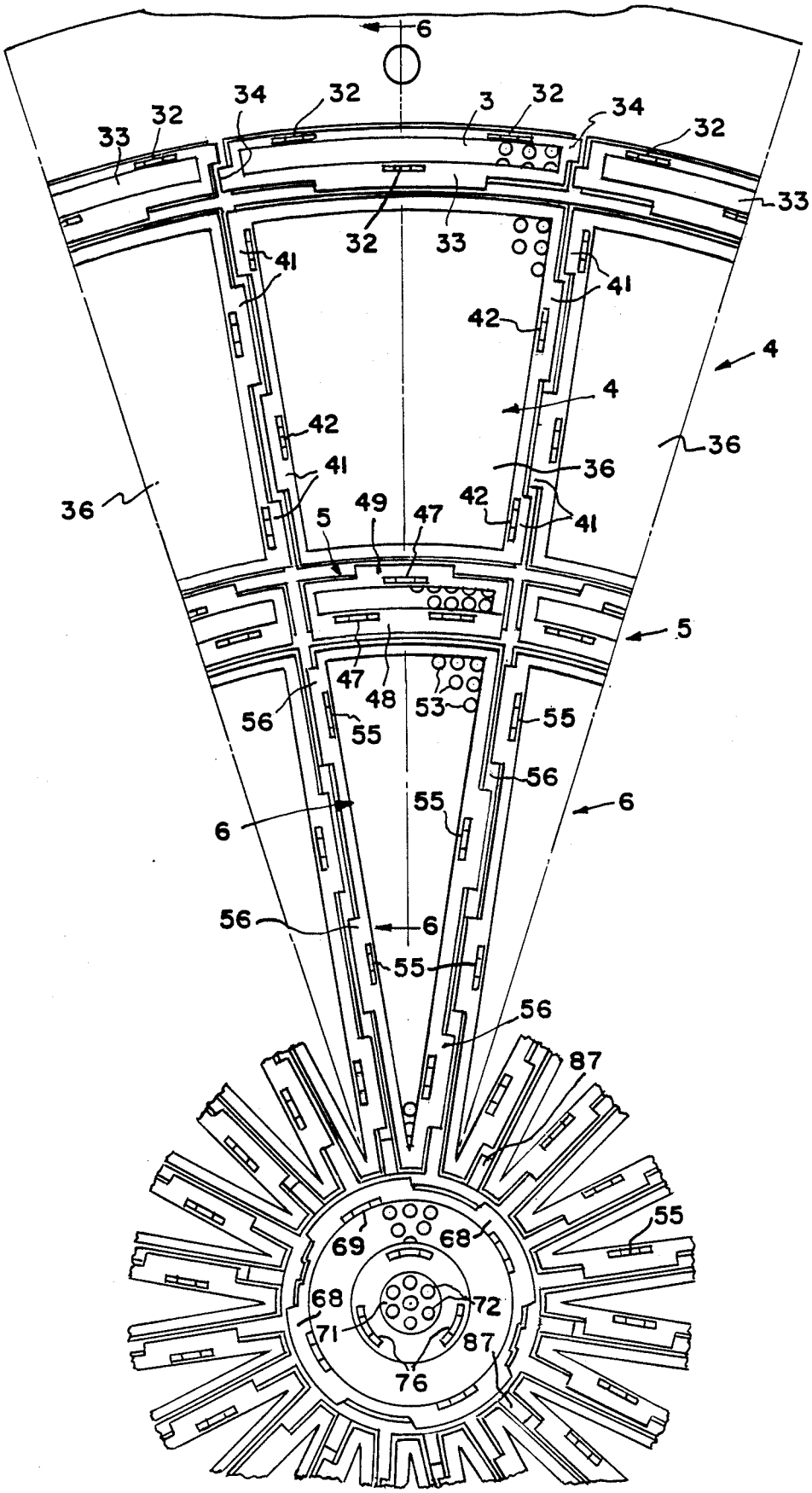
FIG. 5 is an enlarged, fragmentary bottom plan view of the apparatus shown in FIG. 3, but omitting the base.

Each member 3 has an inner end or face 31 that is adapted to confront the base 11 and is provided with a plurality of coplanar foot elements 32 which project beyond the face 31. Adjacent the face 31 the member 3 is provided along the radially inner sides thereof with a lateral projection 33. At each of its opposite ends the member 3 has a lateral projection 34. As is best shown in FIG. 5, the projection 34 at one end of the target member is located at the radially inner side of the member whereas the projection 34 at the opposite end is located at the radially outer edge of the member. Thus, the projections at opposite ends of the member 3 are staggered.

Figure 3:
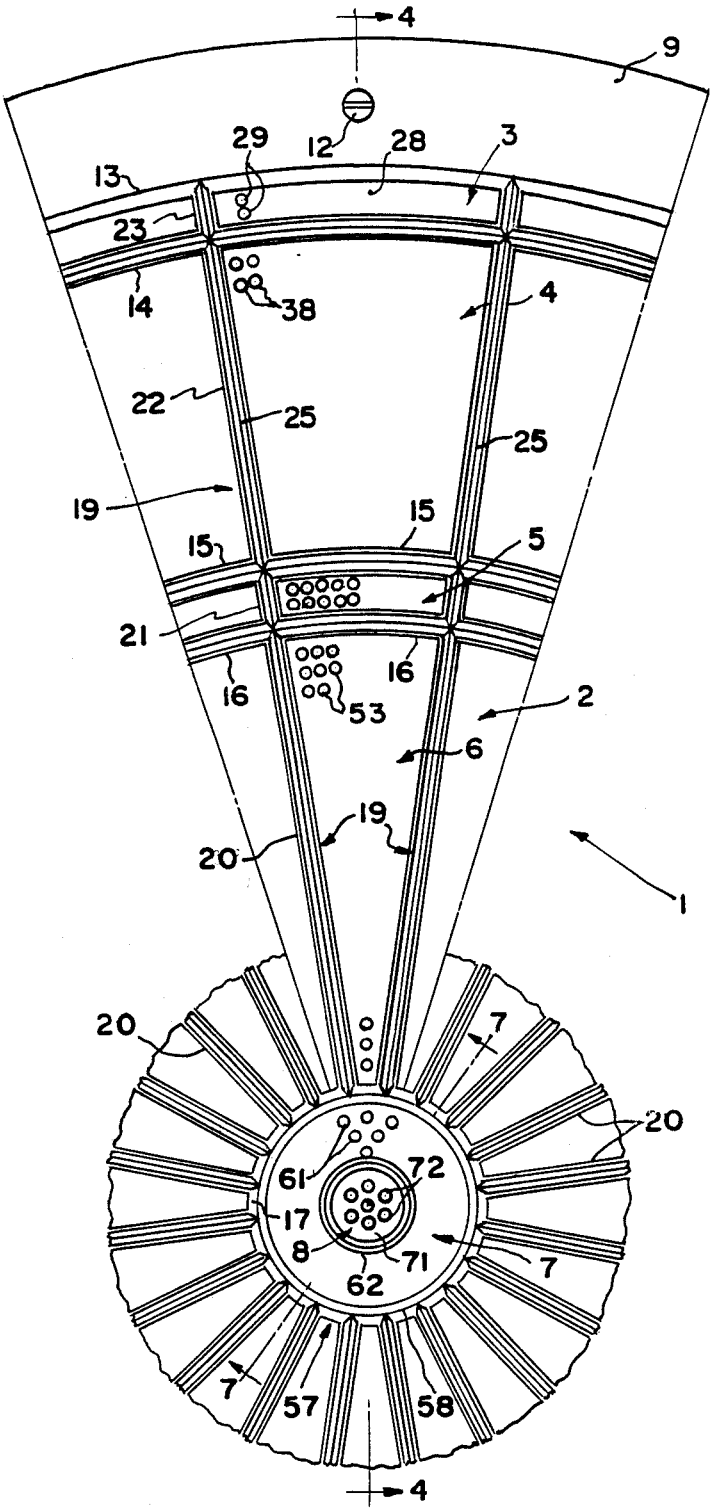
FIG. 3 is a fragmentary enlarged top plan view of a portion of the frame illustrated in FIG. 1, including a base and target members.
Figure 10:
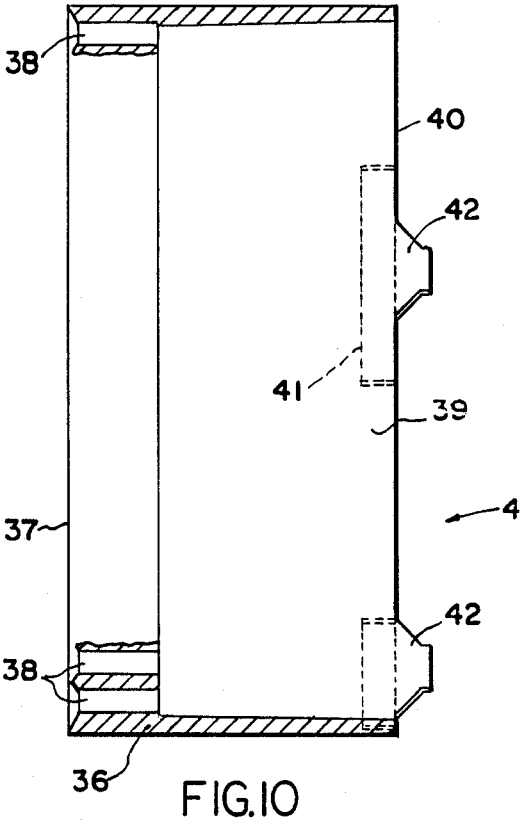
Figure 12:
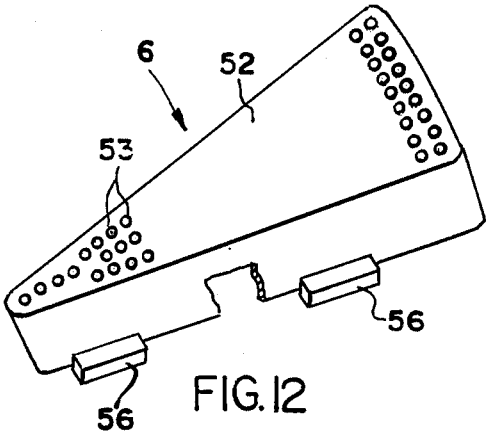
FIG. 12 is an isometric, partly broken away view of one of the target members.

In each space formed between adjacent circular ribs 14 and 15 and adjacent radial rib sections 22 is a segment-shaped target member 4 that is best shown in FIGS. 3, 5, and 10. Each member 4 comprises a body 36 having an outer exposed face 37 the entire area of which is provided with a plurality of openings 38 corresponding in size to the openings 29. The body 36 has a cavity 39 therein with which each of the openings 38 communicates. The body 36 has an inner face 40 from which two pairs of lateral projections 41 extend and, as is best shown in FIG. 5, the projections along one side edge of the body 36 are staggered with respect to the projections along the opposite side of the segment. Two pairs of foot elements 42 like the elements 32 extend rearwardly from the inner face of the segment 4.

Figure 11:
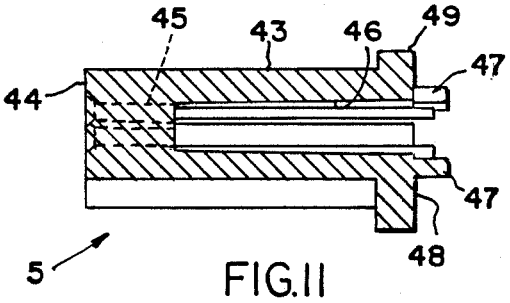

In each space formed between adjacent circular ribs 15 and 16 and the adjacent radial rib sections 21 is an arcuate target member 5 (FIGS. 3, 5, and 11). Each member 5 has a body 43 having an outer face 44 provided with a plurality of openings 45 like the openings 29. The body 43 also has a cavity 46 in communication with the openings 45. From the inner face of the body 43 extend three projecting foot elements 47 best shown in FIG. 5. The member 5 has at its radially inner edge a lateral projection 48 which extends the full length of the member, and at the radially outer edge of the member 5 is a lateral partial projection 49 which extends radially outwardly.

Between the radially innermost circular rib 17 and the next adjacent circular rib 16 is the wedge-shaped target member 6 that is best shown in FIGS. 3, 5, 8, and 12. The member 6 has a body 51 having an outer surface 52 provided with openings 53 like the openings 29 and which communicate with a cavity 54. The inner face of the body 51 is provided with four projecting foot elements 55, two along one side, and two along the other. The member 6 also is provided along its opposite sides with two pairs of lateral projections 56, the projections along one side of the segment being staggered with respect to the projections along the other side, as is best shown in FIG. 5.

Figure 7:
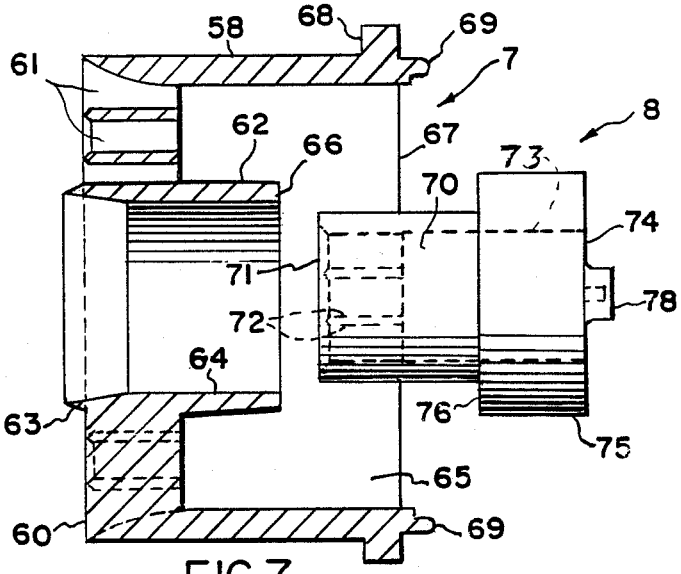
FIG. 7 is a greatly enlarged sectional view taken on the line 7—7 of FIG. 3.
Figure 8:
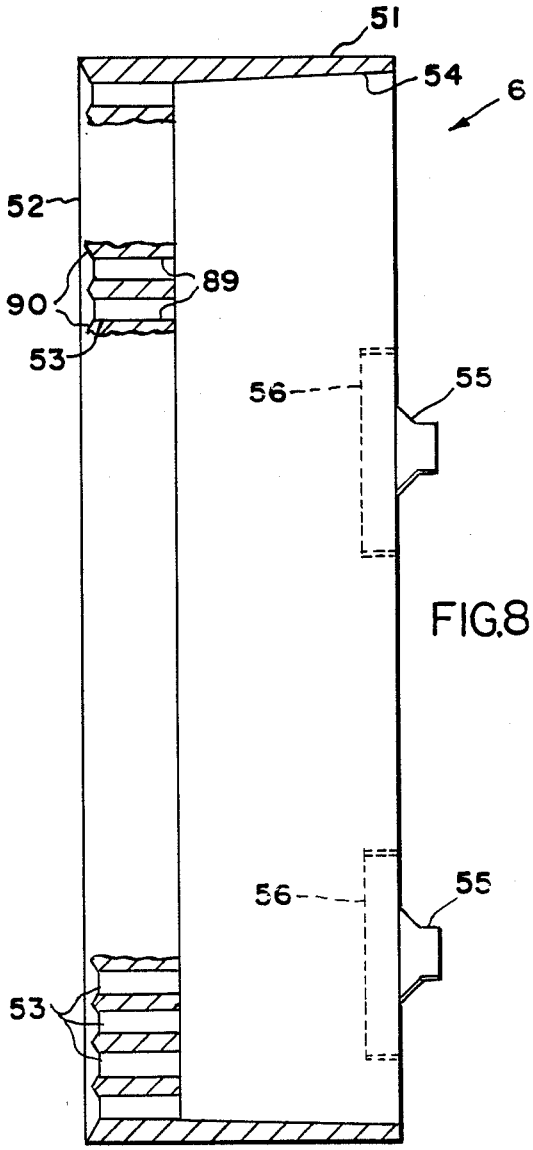
FIGS. 8–11 are sectional views of the various individual target members of which the target is composed.

Within the circular space formed by the innermost circular rib 17 is a bullseye assembly 57 composed of the outer, annular member 7 and the inner, cylindrical member 8. The two members 7 and 8 are best shown in FIG. 7, and for purposes of clarity the members 7 and 8 are shown in separated condition. Such members are shown in assembled condition in FIG. 4.

The member 7 comprises an annular body 58 having an outer, exposed surface 60 through which extend a plurality of openings 61 like the openings 29. The body 58 also includes an annular sleeve 62 having a tapered outer edge 63 and a cylindrical bore 64. The body 58 has a cavity 65 in communication with the openings 61. The sleeve 62 projects into the cavity, but terminates in a free end 66 that is spaced from the inner face 67 of the body 58. Adjacent the inner face 67 the body 58 is provided with four circumferentially spaced, radially extending projections 68 and from the face 67 of the body 58 project four equally spaced foot elements 69.

The inner bullseye member 8 comprises a cylindrical core or body 70 having an outer face 71 provided with openings 72 like the openings 29 and which communicate with a cavity 73 (FIG. 4) that extends to the inner face 74 of the member 8. Adjacent the face 74 of the member 8 is an annular, lateral flange 75 forming a shoulder 76.

Figure 2:
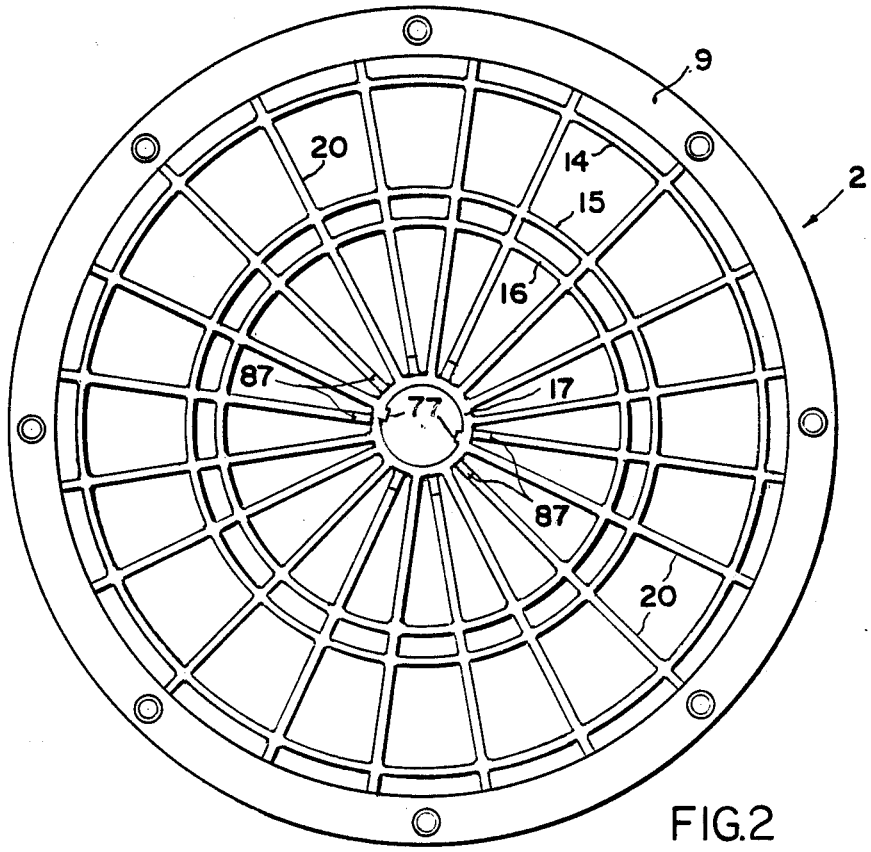
FIG. 2 is a plan view of the inner face of the frame.

The diameter of the outer bullseye member 7 is such as to enable it to be accommodated freely within the circular space formed by the innermost circular rib 17. As is best shown in FIG. 2, the inner periphery of the rib 17 is provided with one or more circumferentially spaced, axially extending keys 77 that may be accommodated in correspondingly spaced keyways (not shown) formed in the outer surface of the body 58 so as to preclude relative rotation between the outer bullseye member 7 and the circular rib 17. Similar keys and keyways may be provided, if desired, on the inner surface of the sleeve 62 and the outer surface of the body 70 of the inner bullseye member 8.

The diameter of the cylindrical body 70 of the inner bullseye member 8 is such as to enable it freely to be accommodated within the sleeve 62, and the relative dimensions of the sleeve 62 and the flange 75 are such that the inner end 66 of the sleeve 62 may seat on the shoulder 76 of the flange 75 when the members 7 and 8 are assembled. In these positions of the parts, two or three circumferentially spaced foot elements 78 fixed to the inner face of the flange 75 will project from the latter and be coplanar with the foot elements 69 of the bullseye member 7.

The base member 11 may be provided with a counterbore 80 (FIG. 4) at the bottom of which is positioned a pressure sensitive, electrical matrix switch 81 of known construction having a plurality of spaced contacts and wiring (not shown) for connection to a source of electrical power. The contacts are arranged to underlie the switch-actuating feet of the respective target members. Overlying the matrix switch 81 is a biasing member 82 such as a resiliently compressible, elastomeric sheet of rubber or rubber-like material. The areas of the counterbore 80, the switch 81, and the biasing member correspond substantially to that of the spider 2 radially inward of the mounting flange 9.

To assemble the component parts of the target, the base 11, the switch 81, and the biasing member 82 are arranged in overlying relation, following which the target members are moved into the correspondingly shaped spaces formed in the spider 2 between the circular and radial ribs. The target members are fitted into their respective spaces from the under side of the spider, or by movement of the members from left to right as viewed in FIG. 6. Following insertion of the target members in the spider's spaces, the mounting flange 9 may be secured to the base 11 by means of the screws 12.

As is best illustrated in FIGS. 4 and 6, the left-hand, or inner, ends of all of the radial and circular ribs (except the outermost circular rib 13) terminate short of the plane of the inner surface of the mounting flange 9, thereby providing between the biasing member 82 and the inner ends of the ribs a space or gap 83 best shown in FIG. 6. The depth of the gap 83 is greater than the thickness of the lateral retainer projections 33, 34, 47, 48, 56, of the respective target members 3, 4, 5, and 6, and such gap also has a depth greater than the thickness of the peripheral retainer projections 68 forming part of the outer bullseye member 7. As a consequence, the respective projections on the target members may extend into the gap 83 to underlie and seat on the terminal ends of the respective circular and radial ribs.

The thickness of the lateral projections is such that a clearance 84 (FIG. 6) normally exists between the inner surfaces of the projections and the free ends of the various foot elements 32, 42, 47, and 55 of the respective target segments 3, 4, 5, and 6, and the foot elements 69 and 78 of the bullseye members 7 and 8, respectively. The length of each of the foot elements is such that it substantially spans the clearance 84 and confronts the surface of the biasing member 82 with a small gap 86 (FIG. 6) therebetween so as normally not to subject the biasing member to compression.

As has been stated earlier, the retaining projections along one side of a target member are staggered relative to the projections along the opposite side. This construction enables two adjacent members on opposite sides of a single rib to underlie that rib without interfering with one another. It also enables the radial thickness of the ribs to be kept to a minimum.

Depending upon the material from which the base 11 is formed and how the base is mounted there may be warping of the base due to temperature and climatic variations. Such warping could result in undesirable forces being exerted on the target members, and particularly those near the center of the target. This may be counteracted, however, by the provision of protrusions 87 at the radially inner ends of selected ones of the ribs 19. See FIGS. 3, 4 and 5. These protrusions are of such length as to bear against the switch 81, and to accommodate such protrusions the biasing member 82 is provided with openings 88 through which the protrusions project. The positions and numbers of the protrusions are so selected that none of them overlies contacts of the switch 81.

The apparatus is adapted for use with a dart (not shown) having at its forward end a tapered, plastic, blunt tip of such size as to fit in any of the tip-accommodating openings formed in the respective target members. When such a dart strikes a target member the latter will be displaced in a direction toward the base 11 with the foot elements of that segment compressing the biasing member 82. The matrix switch 81 has pressure sensitive contacts confronting the respective foot elements so as to be operated in response to such movement of the target member.

The diameter of the dart tip-accommodating openings in all of the target members is the same. As is shown most clearly in FIG. 8, each opening has a uniform diameter or tapered bore 89 matching the taper of the dart tip, and terminating adjacent the outer face of its target member in a mouth having an outwardly diverging side wall 90 for guiding a dart tip into the bore 89. The spacing between adjacent openings is small, as a consequence of which the mouths of adjacent openings inwardly of the side edges of the target members overlap one another.

When the force generated by the energy of a thrown dart's striking the target member has been dissipated, the biasing member 82 will expand, thereby returning the displaced target member to its original position. The movements of the target members toward and away from the base are guided by the smooth, confronting sides of the target members and the adjacent ribs.

The construction of the bullseye assembly 57 is such that, regardless of whether a dart strikes the outer member 7 or the inner member 8, only the struck member will be displaced to effect closing of the associated switch.

As is best illustrated in FIG. 6, no part of any circular or radial spider rib overlies or overhangs any part of any of the target members. Consequently, no part of the spider ribs obscures any of the dart tip-accommodating openings in any of the members.

Retention of the individual target members in relatively movable, assembled relation with the spider is achieved wholly internally of the assembly, and at a level between the outer and inner faces of the target members, by the engagement of the lateral projections of the various target members with the inner surfaces of the spider ribs. It thus is possible to taper the outer or free ends of the ribs to a fine edge, as is shown particularly well in FIG. 6, thereby minimizing the possibility that a dart's striking a rib will cause the dart to rebound. Further, the included angle between opposite tapered surfaces can be relatively small, thereby maximizing the likelihood that a dart's tip, upon striking a rib, will be deflected into one of the tip-accommodating openings.

Since no part of any of the spider's ribs need overlie any part of a target segment, the ribs can be made quite thin, thereby maximizing the number of dart tip-accommodating openings that can be provided in the segments.

Although the target disclosed herein is circular in form, the principles on which the invention is based can be applied to a target of any desired geometric form.

The disclosed embodiment is representative of a presently preferred form of the invention, but is intended to be illustrative rather than definitive thereof. The invention is defined in the claims.

What is claimed is:

1. A game target comprising a base; a plurality of individual, relatively movable target members each of which has and inner face confronting said base and an outer face; a divider interposed between adjacent members; means securing said divider to said base; and cooperable retaining means reacting between said divider and each adjacent member at a level wholly inward of the outer face thereof enabling movements of each of said members in directions toward and away from said base and limiting movement of said members in a direction away from said base.

2. A target according to claim 1 wherein said level is between the inner and outer faces of said members.

3. A target according to claim 1 wherein said divider has a tapered free end remote from said base.

4. A target according to claim 1 including biasing means interposed between said base and the inner faces of said members and biasing said members in a direction away from said base.

5. A target according to claim 4 wherein said divider has an inner surface confronting said base and spaced therefrom, the adjacent target members having lateral projections extending into the space between said members and said base.

6. A target according to claim 5 wherein the projections of a target member at one side of said divider are staggered relative to the projections of a target member at the opposite side of said divider.

7. A target according to claim 4 wherein said divider has at least one protrusion projecting toward said base and extending through said biasing means.

8. A target according to claim 1 wherein said target members together form a circle and wherein said divider comprises a plurality of concentric, circular ribs connected by radial ribs.

9. A target according to claim 8 wherein the radially innermost circular rib forms a circular space within which is an annular body, said body having at its inner end laterally extending projections underlying said innermost rib.

10. A target according to claim 9 wherein within said annular body is a reciprocable, cylindrical core, said core having a lateral flange underlying said body.

11. A target according to claim 1 wherein each of said target members has a plurality of openings in its outer face.

12. A target according to claim 11 wherein each of said members has a cavity therein in communication with said openings.

13. A target according to claim 11 wherein each of said openings comprises a substantially uniform diameter bore terminating at the outer face in diverging sides.

14. A target according to claim 11 wherein each of said openings comprises a substantially tapering bore terminating at the outer face in diverging sides.

15. A target according to claim 1 including electrical switch means interposed between said base and said target members, and switch operating means carried by said target members for operating said switch means in response to said movements of said target segments.

16. A target according to claim 15 wherein said switch operating means comprises a plurality of foot elements carried by each of said target members and confronting said switch means.

17. A game target comprising a base; a frame composed of a plurality of interconnected rib members defining spaces therebetween; means securing said frame to said base in overlying relation therewith; a plurality of individual target members each of which has an inner face confronting said base and an outer face, each of said target members occupying a separate one of said spaces and being independently movable in directions toward and away from said base; and retaining means carried by one of said target or rib members and projecting into a gap formed by the other of said rib or target members at a level inward of said outer face, said retaining means permitting movements of said target members in said directions and limiting movement of said target members in a direction away from said base.

18. A target according to claim 17 wherein said retaining means are located at a level between the inner and outer faces of said target members.

19. A target according to claim 17 wherein said retaining means is carried by said target members.

20. A target according to claim 19 wherein said retainer means comprise projections at opposite sides of each of said target members, the projections at one side being staggered with respect to the projections at the opposite side.

21. A target according to claim 17 wherein selected ones of said ribs carry protrusions extending in a direction toward said base.

22. A game target comprising a base; a frame composed of a plurality of interconnected ribs joined to one another and defining spaces therebetween; means securing said frame to said base in overlying relation therewith; a plurality of individual target members each of which has an inner face confronting said base and an outer face, each of said target members occupying a separate one of said spaces and conforming in shape therewith, each of said target members being movable independently of each other target member in directions toward and away from said base; and retaining projections carried by each of said target members and located inwardly of the outer face thereof, and said projections extending laterally of said target members a distance sufficient to be received in a space between an adjacent rib and said base and underlie such rib, whereby movement of each of said target members in a direction away from said base is limited by engagement between the projections on said target member and the adjacent rib.

23. A target according to claim 22 wherein the projections at one side of each target member are staggered with respect to the projections at the opposite side thereof.

24. A target according to claim 22 wherein one of said target members comprises an annular body having a sleeve at its center and a core accommodated in said sleeve, said annular body having peripheral projections extending therefrom and said core having a peripheral flange engageable with said sleeve.

25. A target according to claim 22 including yieldable biasing means reacting between said base and said target members for biasing the latter in a direction away from said base.

26. A target according to claim 22 wherein each of said ribs terminates in an outer free edge no part of which overlies any part of any of said target members.

27. A target according to claim 26 wherein the outer free edge of each of said ribs is tapered.

28. A target according to claim 22 wherein each of said target members has a plurality of openings therein.

29. A target according to claim 22 wherein selected ones of said ribs carry at selected locations thereon protrusions extending in a direction toward said base.

30. A target according to claim 29 including a layer of resilient material interposed between said ribs and said base, said material having openings therein accommodating said protrusions.

31. A game target comprising a base; a plurality of individual, relatively movable target members each of which has an inner face confronting said base and an outer face; a divider interposed between adjacent ones of said members; means securing said divider to said base in fixed position relative thereto; means biasing said members in a direction away from said base; and cooperable retaining means reacting between said divider and each adjacent member and being positioned at a level wholly inward of the outer face thereof, said retaining means enabling movements of each of said members in directions toward and away from said base and limiting movement of said members in a direction away from said base.

32. A game target comprising a base; a frame composed of a plurality of interconnected rib members defining spaces therebetween; means securing said frame to said base in fixed, overlying relation therewith; a plurality of individual target members each of which has an inner face confronting said base and an outer face, each of said target members occupying a separate one of said spaces and being independently movable in directions toward and away from said base; means biasing said target members in a direction away from said base; and retaining means carried by one of said target or rib members and projecting into a gap formed by the other of said rib or target members at a level wholly inward of said outer face, said retaining means permitting movements of said target members in said directions and limiting movement of said target members in a direction away from said base.

33. A game target comprising a base; a frame composed of a plurality of interconnected ribs joined to one another and defining spaces therebetween; means securing said frame to said base in fixed, overlying relation therewith; a plurality of individual target members each of which has an inner face confronting said base and an outer face, each of said target members occupying a separate one of said spaces and conforming in shape therewith, each of said target members being movable independently of each other target member in directions toward and away from said base; means biasing said target members in a direction away from said base; and retaining projections carried by each of said target members at a level wholly inward of said outer face and extending laterally of such target member a distance sufficient to be received in a space between an adjacent rib and said base and underlie such rib, whereby movement of each of said target members in a direction away from said base is limited by engagement between a projection on said target member and the adjacent rib.

* * * * *